US010441486B2

(12) United States Patent
Fakhrizadeh

(10) Patent No.: US 10,441,486 B2
(45) Date of Patent: Oct. 15, 2019

(54) MULTIFUNCTIONAL MULTI-POSITIONAL ORTHOPEDIC MATTRESS

(71) Applicant: Mohammad Fakhrizadeh, Saveh (IR)

(72) Inventor: Mohammad Fakhrizadeh, Saveh (IR)

( * ) Notice: Subject to any disclaimer, the term of this patent is extended or adjusted under 35 U.S.C. 154(b) by 317 days.

(21) Appl. No.: 15/398,679

(22) Filed: Jan. 4, 2017

(65) Prior Publication Data

US 2019/0151172 A1 May 23, 2019

(30) Foreign Application Priority Data

May 1, 2016 (IR) ..... 139450140003011362

(51) Int. Cl.
*A61G 7/015* (2006.01)
*A61G 7/05* (2006.01)
*A61G 7/057* (2006.01)

(52) U.S. Cl.
CPC ..... *A61G 7/015* (2013.01); *A61G 7/0507* (2013.01); *A61G 7/0573* (2013.01)

(58) Field of Classification Search
CPC ..... A47C 27/001; A47C 27/14; A47C 27/142; A47C 27/146; A47C 27/148; A47C 27/15; A61G 7/005; A61G 7/015; A61G 13/04; A61G 13/08
USPC ..... 5/691, 722, 728
See application file for complete search history.

(56) References Cited

U.S. PATENT DOCUMENTS 5,400,448 A * 3/1995 Zwickey ..... A61G 1/04 128/870
5,566,409 A * 10/1996 Klearman ..... A47C 27/082 5/706
5,950,262 A * 9/1999 Smoler ..... A61G 13/0018 188/5
6,694,548 B2 2/2004 Foster et al.
7,346,945 B2 * 3/2008 Phillips ..... A61G 7/015 5/616

(Continued)

*Primary Examiner* — Robert G Santos
*Assistant Examiner* — Alexis Felix Lopez
(74) *Attorney, Agent, or Firm* — NovoTechIP International PLLC

(57) ABSTRACT

A multi-functional multi-positional orthopedic mattress for use with patients is disclosed. The multi-functional multi-positional orthopedic mattress includes a top layer, an intermediate layer and a bottom layer. The top layer is made from a plurality of separately removable cushioned pads. The intermediate layer includes a plurality of rotatably connected structures which allow for rotation of various parts of the mattress in different angels. The bottom layer includes a plurality of non-movable and movable pads. The three layers are connected in such a way as to provide the ability to move a patient residing on the mattress into various positions. This enables the patient to move different parts of their body without having to move others and helps prevent bedsores and other health risks associated with prolong bed rest. The mattress also provides positions that enable caregivers to easily and comfortably change a patient's clothing, wash their body and provide a multitude of other care services. In one embodiment, the mattress does not have any driving elements of its own (e.g. an actuator). Instead, most common patient lifts can be utilized with the mattress to bring about any desired position. The mattress could also be placed on most beds or on the floor, as needed.

10 Claims, 6 Drawing Sheets

(56) References Cited

U.S. PATENT DOCUMENTS

| | | | | |
|---|---|---|---|---|
| 7,690,060 | B2 * | 4/2010 | Rodrigues Moreira | A47C 20/04 5/613 |
| 8,001,638 | B1 * | 8/2011 | Quinter | A47D 15/001 5/690 |
| 8,266,746 | B2 * | 9/2012 | Oh | A47C 20/041 5/617 |
| 8,359,689 | B2 | 1/2013 | Warren et al. | |
| 8,474,072 | B2 | 7/2013 | O'Keefe et al. | |
| 8,640,285 | B2 | 2/2014 | Heimbrock et al. | |
| 8,651,569 | B2 * | 2/2014 | Andoloro | A47C 1/026 297/195.11 |
| 8,661,585 | B1 * | 3/2014 | Alasfour | A61G 7/015 5/604 |
| 2002/0152552 | A1 * | 10/2002 | Dewert | A47C 20/041 5/618 |
| 2006/0260051 | A1 * | 11/2006 | Paz | A61G 7/002 5/618 |
| 2007/0234482 | A1 * | 10/2007 | Wright | A47C 20/045 5/722 |
| 2010/0242176 | A1 * | 9/2010 | Newkirk | A61G 7/0507 5/602 |
| 2011/0010859 | A1 * | 1/2011 | Teeter | A61G 7/015 5/616 |
| 2014/0283305 | A1 | 9/2014 | Zysman | |

* cited by examiner

MULTIFUNCTIONAL MULTI-POSITIONAL ORTHOPEDIC MATTRESS

CROSS REFERENCE TO RELATED APPLICATION

This application claims the benefit of priority to an Iran patent application having serial number 139450140003011362, which was filed on Jan. 5, 2016, and is incorporated by reference herein in its entirety.

TECHNICAL FIELD

The present application relates generally to an orthopedic mattress, and more particularly, to a multifunctional multi-positional orthopedic mattress.

BACKGROUND

During a patient's stay in a hospital, the patient is normally confined to his or her hospital bed for at least some period of time. This is also true for patients in long term care facilities. Some of these patients have to stay in their beds for long periods of time without any physical movement. Patients having limited mobility often suffer from soreness, muscle atrophy and other problems arising from lack of movement. This is a common and sometime serious issue for these patients. Immobility can lead to complications causing serious illness and disability. However, for patients on bed rest or those with conditions that prevent them from being able to get up and/or walk, there are limited options for movement. This is particularly true since currently used hospital beds and mattresses offer very few options for moving different parts of the body.

For a patient that is confined to his or her bed, all of the care functions provided by attending physicians, nurses and the like have to be provided to the patient as he or she resides on the hospital bed. It is often very difficult for nurses or care takers to properly care for such individuals. For example, changing clothes or giving a bath to a person that has to lie in a bed and cannot move can be very complicated.

Additionally, when a patient is lying in his/her bed, they are confined within a limited boundary. This can be both inconvenient and mentally challenging. Moreover, the fear of falling may prevent the patient from using some of their abilities.

Therefore, a need exists for a solution for providing a comfortable, easily foldable, portable, and adjustable mattress for long-term patients.

SUMMARY

The instant application describes a multi-positional orthopedic mattress. The orthopedic mattress includes a top layer including a plurality of separately removable pads, an intermediate layer including a plurality of sections, and a bottom layer including a plurality of pads. In one embodiment, at least one of the plurality of pads is not movable while at least another one of the plurality of pads can be rotated around an axis. In one embodiment, at least two of the plurality of sections of the intermediate layer are connected rotatably such that an angle between the at least two of the plurality of sections can be adjusted.

BRIEF DESCRIPTION OF THE DRAWINGS

Features of the subject technology are set forth in the appended claims. However, for purpose of explanation, several implementations of the subject technology are set forth in the following figures.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings. As part of the description, some of this disclosure's drawings represent structures and devices in block diagram form in order to avoid obscuring the invention. In the interest of clarity, not all features of an actual implementation are described in this specification. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

Patients having long term mobility issues or those that have surgeries or other procedures that prevent them from being able to move are often confined to their beds for a long period of time. All systems of the body function best with some physical activity. As a result, lack of mobility can have serious negative consequences. Additionally, it is often very difficult to properly care for patients that cannot or should not move certain parts of their body.

Various solutions may be considered to solve the above issues. Some of the solutions may include an adjustable multi-functional multi-positional orthopedic mattress. The orthopedic mattress allows for easily placing the patient in different positions, such as sitting and lying down with different adjustable angles, as well as various foot positions and motions. These movements greatly reduce the chances of bedsores and other complications caused by immobility. Additionally, the mattress provides multiple options for dressing, bathing and providing other care functions for nurses and caretakers, which make their work considerably easier.

Figure 1:
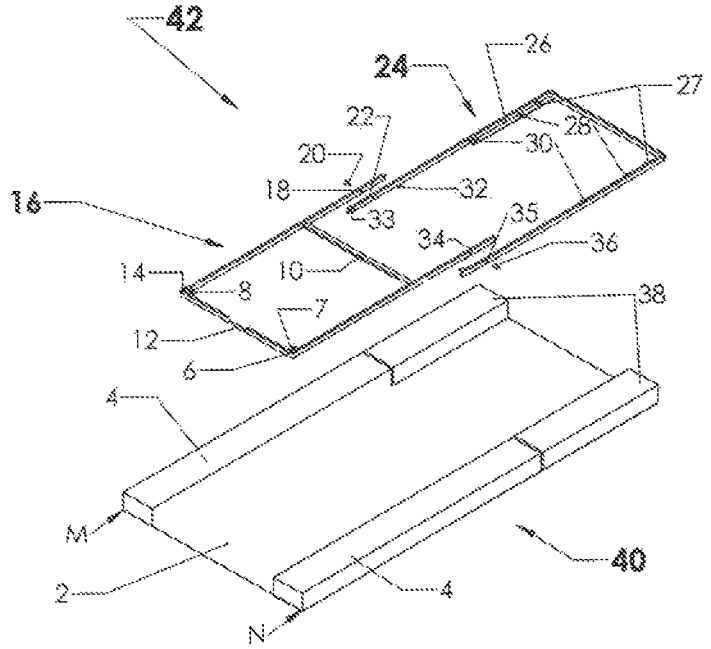
FIG. 1 illustrates a schematic drawing of parts of an intermediate layer and bottom layer of an orthopedic mattress, according to an implementation.

In one embodiment, the multi-functional multi-positional orthopedic mattress includes several layers, each of which is formed from multiple parts. In a preferred embodiment of the present disclosure, the layers include a bottom layer, an intermediate layer, and a top layer. FIG. 1 illustrates an embodiment of a bottom layer 40 and the outer frame 42 of the intermediate layer of the orthopedic mattress. In one embodiment, the bottom layer 40 includes a middle section 2 which is made from a type of fabric, in one configuration. In another embodiment, the middle section 2 is made from a tarpaulin like material. Middle section 2 can be made from a variety of other known materials. The bottom layer 40 also includes two lower-side cushioned pads 4 on each side of the middle section 2. The left lower-side cushioned pad 4 rotates around the axis M to the outside and the right lower-side cushioned pad 4 rotates around the axis N to the outside to provide access for a lift to get closer to the center of gravity of a patient when the mattress is placed on the floor. The bottom layer 40 also includes two higher-side cushions 38 that do not need to be movable, in one embodiment.

FIG. 1 also illustrates one embodiment of the outer frame 42 of the intermediate layer of the orthopedic mattress. The lower part 16 of the outer frame 42 includes two slots 7 and 8, locking mechanisms 6 and 14, a slot 12 for providing access to the wheel of a portable assistive lift, a loop 10 for attaching a belt or strap, and openings 18 and 34. The upper part 24 of the outer frame 42 includes protrusions 32 and 33 and a railing 26 on one side (left side) and symmetrical protrusions and a railing on the other side (not shown). The upper part 24 also includes bores 22 and 35 and a base plate 26 at the distal end on both sides of the upper part 24 and stoppers 27, 28 and 30. In one embodiment, the upper part 24 can be attached to the lower part 16 by inserting a pin or a screw 22 into the bores 18 and 22 on one side and inserting a pin or screw 36 into the bores 35 and 34 on the other side. In one embodiment, these four bores are coaxial. As a result, the upper part 24 and lower part 26 can be rotated around the pins 22 and 36. In one embodiment, because of protrusions 32 and 33 (and their symmetrical protrusions on the right side of the frame), the rotation can only occur in one direction.

Figure 2:
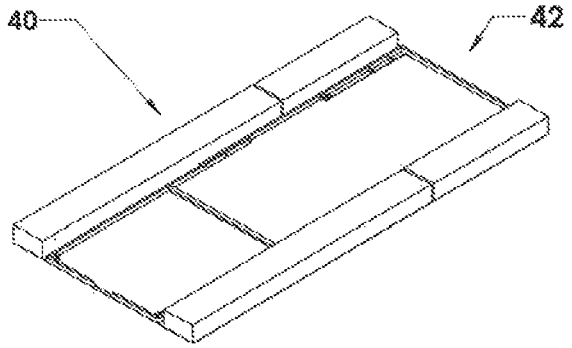
FIG. 2 illustrates a schematic drawing of connected parts of an intermediate layer and bottom layer of an orthopedic mattress, according to an implementation.
Figure 3:
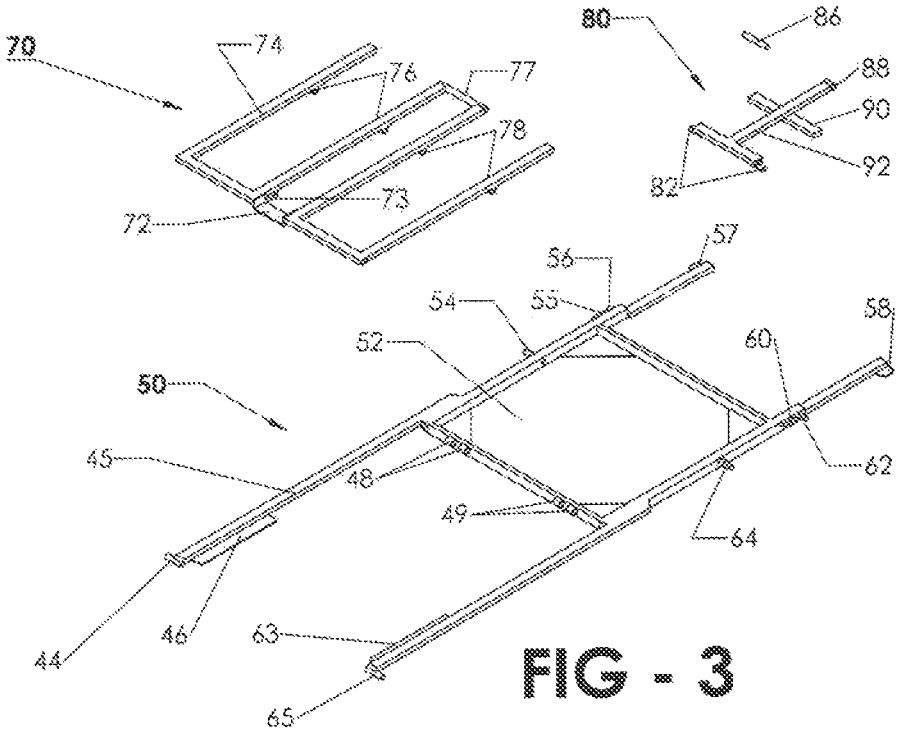
FIG. 3 illustrates schematic drawings of various structures of an intermediate layer of an orthopedic mattress, according to an implementation.

FIG. 2 illustrates how after the upper part 24 and lower part 16 have been attached to form the outer frame 42, the outer frame 42 of the intermediate layer can be positioned in the bottom layer 40 of the orthopedic mattress. In one embodiment, in addition to the outer frame 42, the intermediate layer of the orthopedic mattress includes multiple other sections. Some of these are illustrated in FIG. 3. In one embodiment, a structure 50 of the intermediate layer includes a main structure 45. The main structure 45 has protruded portions 44, 54, and 56, sidings 46 and 57 and a loop 55 for accepting a hook or a belt or strap on the left side of the structure 50. Similarly protruded portions 65, 64, and 62, sidings 63 and 58 and a loop 60 for attaching a belt or strap are located on the right side of the main structure 45. In one embodiment, the middle portion of structure 50 includes a tray 52, and base hinges 48 and 49.

Figure 4:
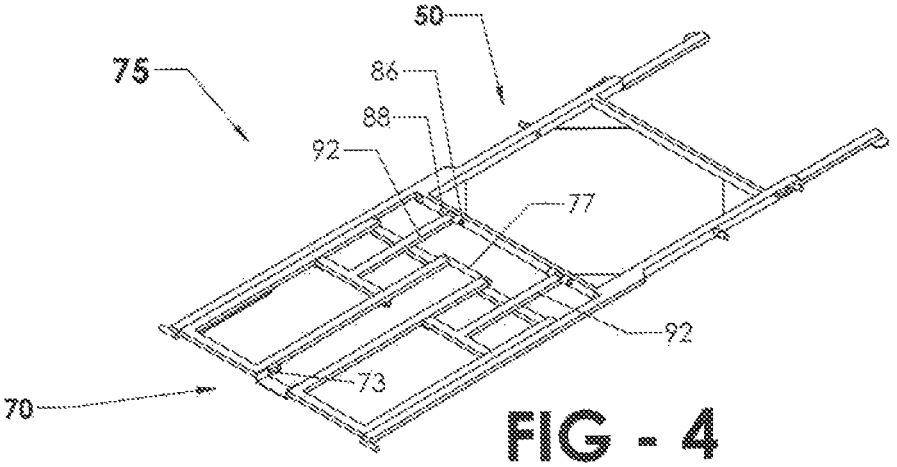
FIG. 4 illustrates a schematic drawing showing how the various structures of FIG. 3 are connected, according to an implementation.
Figure 6:
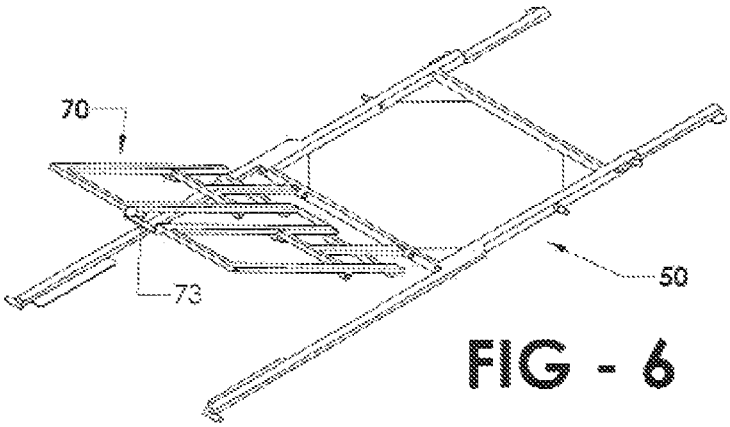
FIG. 6 illustrates an alternative schematic drawing showing how the various connected structures of FIG. 3 can be moved, according to an implementation.
Figure 7:
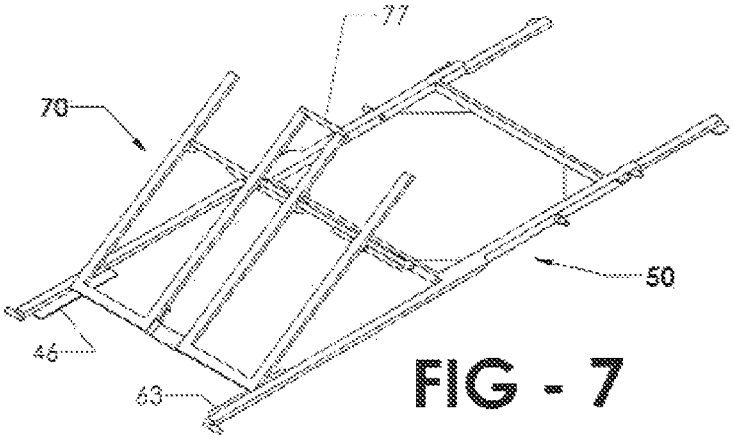
FIG. 7 illustrates another alternative schematic drawing showing how the various connected structures of FIG. 3 can be moved, according to an implementation.

In one embodiment, the intermediate layer also includes a structure 70 and two structures 80, as shown in FIG. 3. Structure 70 is formed of a reverse bridge 72, a loop 73 for attaching a hook or a belt or strap , two U-shaped sections 74, two bores 76, two bores 78 and connector 77. These portions are specifically designed such that structure 70 can fit into and be attached to other sections of the intermediate layer. In the same light, structure 80 of the intermediate layer includes a T-shaped portion 92, two protrusions 82, a bore 88, and a barrier 90. In one embodiment, two structures 80 fit into and are attached to the structure 70. This is done by placing each structure 80 into one of the U-Shaped sections 74, aligning bores 76 and 78 with protrusions 82, and inserting the protrusions 82 into the openings 76 and 78. In one embodiment, this type of insertion allows for rotation of the structure 80 in one direction. The rotation only occurs in one direction and is restricted on the direction because of the barrier 90. After the two structures 80 are connected to the structure 70, the bore 88 of each structure is aligned with the hinges 48 and 49 of the structure 50, such that the structure 70 is placed on the two sidings 46 and 63. Consequently, two pins 86 are inserted into each of the openings 88 to connect the attached structures 70 and 80 to the structure 50. This connection provides an ability for rotation in one direction. The resulting attached structure 75 is illustrated in FIG. 4. In one embodiment, the lower side of the attached structure 75 is placed under the patient's lower extremities (i.e., buttocks and legs). Because of the flexibility and rotatability of various parts of the attached structure 75, various parts can be moved in different directions. This is illustrated in FIGS. 5-7.

Figure 5:
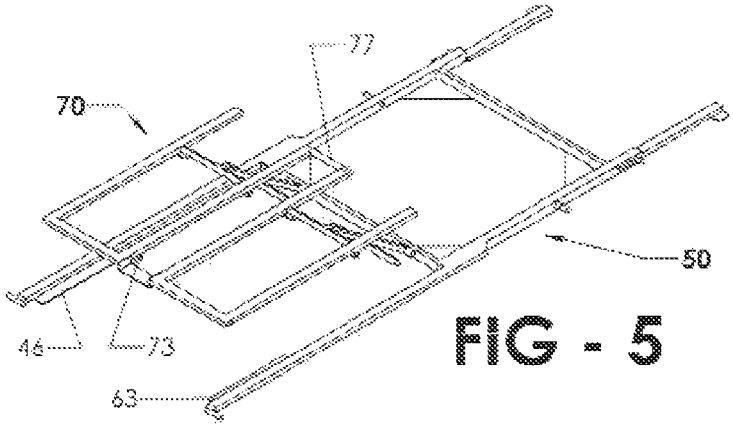
FIG. 5 illustrates a schematic drawing showing how the various connected structures of FIG. 3 can be moved, according to an implementation.

FIG. 5 illustrates one mode of operation for the attached structure 75. By inserting a hook through the loop 73 and another hook around the connector 77 and pulling the hooks upward, the structures 70 and 80 can be moved as shown. The angle and direction of the structures 70 and 80 with respect to the structure 50 can be changed by varying the length of the belt and/or the way the belt is pulled. The resultant structure allows for moving the legs and the thighs of a patient when the knees are bent. FIG. 6 illustrates another mode of operation for the attached structure 75. This form of the attached structure 75 can occur, when a hook is inserted into the loop 73 and pulled upward. This allows for moving the legs upwards when the knees are not bent. FIG. 7 illustrates yet another mode of operation for the attached structure 75. This occurs when a hook is only around the connector 77 and pulled upwards. This provides the patient and caregivers the possibility of raising the thighs while the knees are bent downwards.

Figure 8:
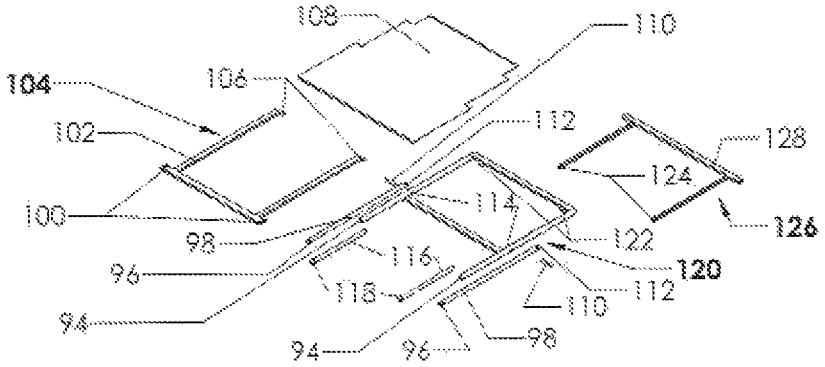
FIG. 8 illustrates schematic drawings of various structures of an intermediate layer of an orthopedic mattress, according to an implementation.

FIG. 8 illustrates a few additional structures of the intermediate layer of the orthopedic mattress. As shown, structure 104 includes two loops 100, two arms 102 and protrusions 106. Structure 120 has two coaxial hinges 122, coaxial bores 114 and two hollow rods 94. The base structure 126 has a connector 128 and coaxial openings 124. FIG. 8 also shows a few additional parts used in attaching the various structures of the intermediate layer. These parts include an upper body support plate 108, two connectors 98 having bores 96 and 110 on each side, two rods 116 having bores 118 on one side and pins 110. In one embodiment, structures 120 and 126 and two connectors 98 are connected together rotatably through openings 114, 124 and 112 by pins 110.

Figure 9:
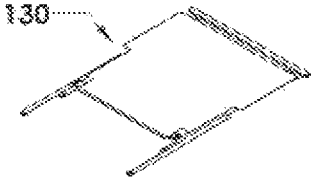
FIG. 9 illustrates a schematic drawing showing how the various structures of FIG. 8 are connected, according to an implementation.
Figure 10:
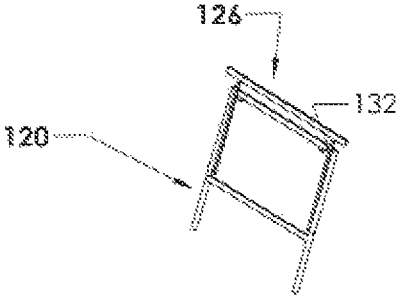
FIG. 10 illustrates an alternative view of the connected structures of FIG. 8, according to an implementation.

As illustrated in FIG. 9, structures 120 and 126 can be connected together with insertion 108 by using the two connectors 98 and pins 110 which, in one embodiment, are inserted into openings 114, 124 and 112. The combined structure 130 of FIG. 8 is rotatable and is placed, in one embodiment, on the upper part of the structure shown in FIG. 7 such that it fits underneath the shoulder and upper back area of a patient once he or she is placed on the mattress. FIG. 10 illustrates a different view of the combined structure (130). In this view, a locking mechanism 132 which fits into the top portion of the structure 120 to form the combined structure 130 is also shown. The locking mechanism 130 provides the ability to lock the parts of the combined structure 130 together so they do not rotate. When locked, structures 120 and 126 are immovably attached. However, when left unlocked, structure 126 can rotate around the axis of pins 110 in relation to structure 120.

Figure 11:
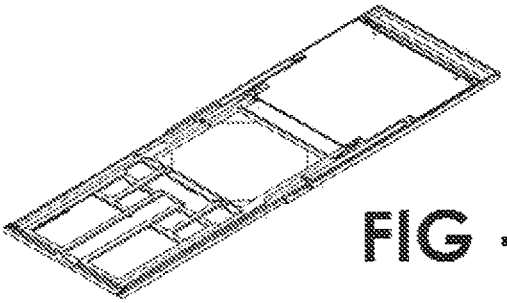
FIG. 11 illustrates a schematic drawing showing how the various structures of FIGS. 4 and 9 are connected, according to an implementation.
Figure 12:
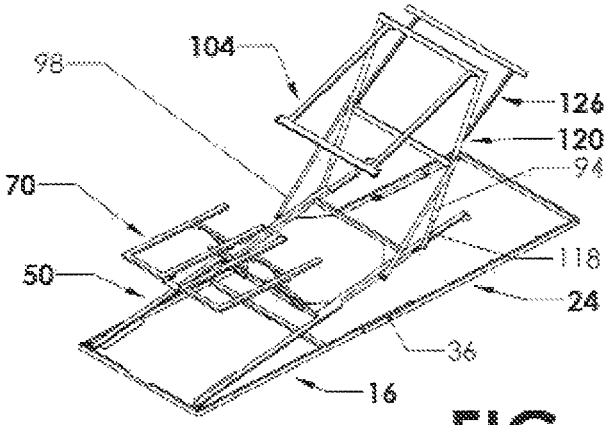
FIG. 12 illustrates an alternative view of the connected structures of FIG. 11, according to an implementation.

FIG. 11 illustrates one embodiment of a fully assembled intermediate layer of the orthopedic mattress. This is a view of the intermediate layer when all the different parts are fixed and flat. However, as discussed before, various sections of the intermediate layer are movable and rotatable with respect other parts to provide different positions for the mattress. One view of an expanded position of the intermediate layer is shown in FIG. 12. FIG. 12 also illustrates how some of the various structures that form the intermediate layer can be connected. For example, bore 118 of the two rods 116 (FIG. 8) are aligned with protruded portions 56 and 62 (FIG. 3) before the rods 118 are inserted into the openings of the hollow rods 94. Protruded portions 54 and 64 (FIG. 3) are also inserted into bore 96 of the connectors 98. Moreover, protrusions 106 of rods 102 are rotatably connected to the coaxial hinges 122 of structure 120 before being covered with upper body support plate 108. Additionally, protruded portions 44 and 65 (FIG. 3) are inserted into slots 7 and 8 (FIG. 1) of the outer frame before being locked into place by locking mechanisms 6 and 14 (FIG. 1). These types of connections between the various structures provide the ability to change the angle of the various structures with respect to others to provide a multi-positional mattress. For example, the angle of structure 120 with respect to structure 50 can be changed to move the mattress and as a result the patient to a sitting position while changing its height with respect to the main structure 45. This prevents the mattress from pushing the patient forward when sitting. As a result of the presence of sidings 57 and 58, the angle between structures 120 and 50 cannot be less than zero.

Figure 13:
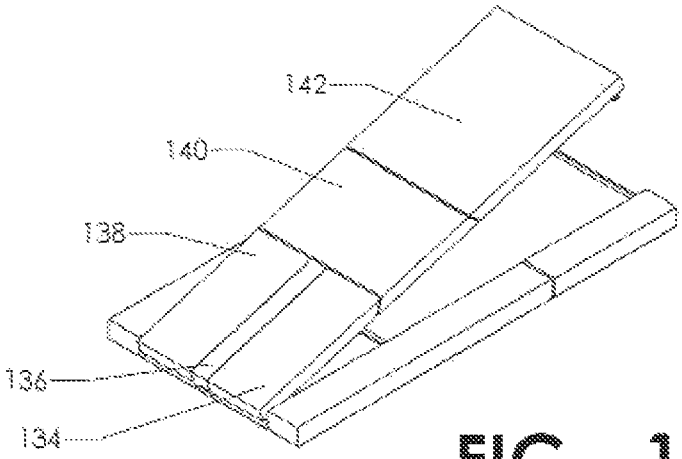
FIG. 13 illustrates a schematic drawing of an orthopedic mattress having top, intermediate and bottom layers, according to an implementation.

FIG. 13 illustrates one embodiment (in a reverse Trendelenburg position when the loops of 55 and 60 of FIG. 3 are used) of the top layer of the orthopedic mattress being inserted placed on top of the combined intermediate and bottom layers. As shown, the top layer includes multiple separate cushioned pads. These include pads 134 and 138 which cover areas allocated for the placement of thighs and legs of the patient, and pad 136 which covers the area allocated for the space between the two legs. The top layer also includes a pad 140 allocated for the placement of the hips and pad 142 configured to cover the area behind the shoulders and the lower back. The pads can be made from various different materials known in the art which are appropriate for hospital and patient mattresses. There are a variety of ways by which each of the different pads can be connected to a corresponding structure of the intermediate layer.

In one embodiment, to bring the patient to a sitting position when lying on the mattress, the loops of 55 and 60 of FIG. 3 are coupled to the hooks of a lift. Upon lifting the mattress upward, the patient would first be positioned in the Reverse Trendelenburg position. Consequently, the locking system 132 of FIG. 10 is released and the connector 128 of the structure 126 of FIG. 8 is thus allowed to freely slide (using gravity) on the base plates 26 of FIG. 1. By lowering the lift, depending on the angle of the reverse Trendelenburg, the connector 128 will stop behind any sets of the stoppers 27, 28 or 30 to bring the patient to a desired angle of sitting position without using any physical force from a care giver.

In one embodiment, when the hooks of a lift are coupled to the loops 100 of FIG. 8 and the patient is lying down on the mattress, upon lifting, the patient could be placed at the drainage position.

Figure 14:
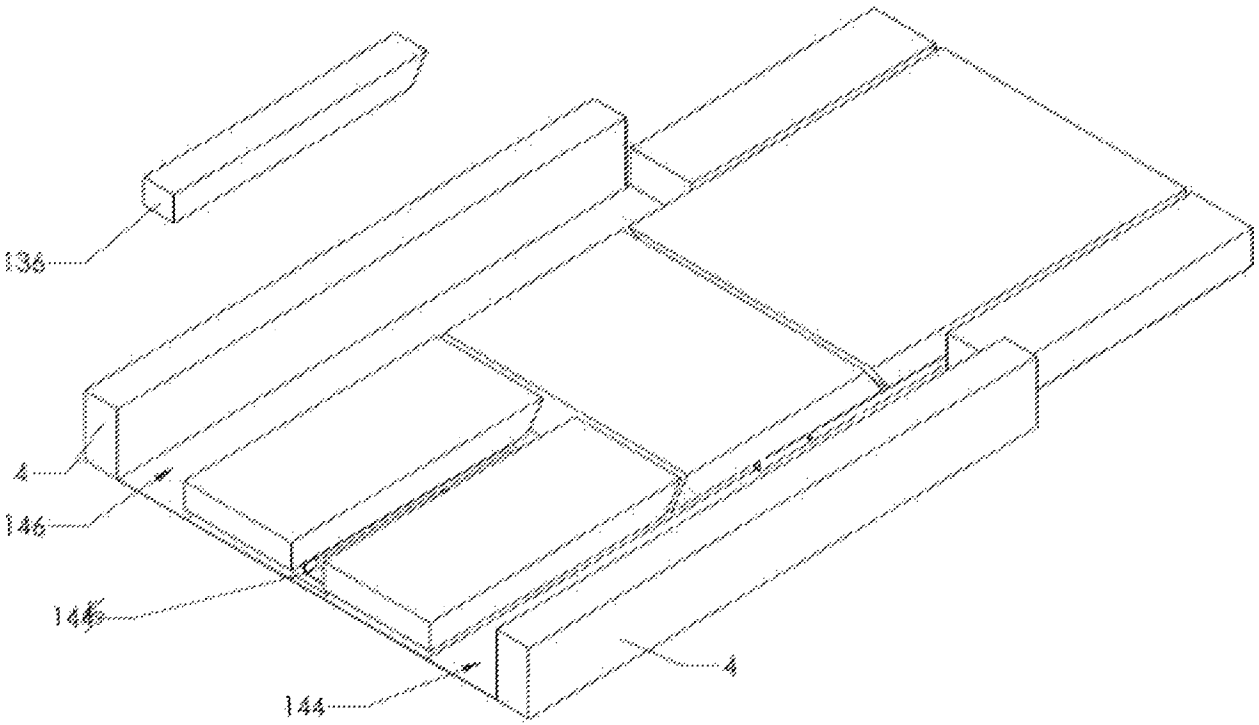
FIG. 14 illustrates a schematic drawing of one of the positions of the orthopedic mattress, according to an implementation.

FIG. 14 illustrates one position of the fully assembled orthopedic mattress, in one embodiment. In this position, each of the two lower-side cushioned pads 4 has been rotated towards outside around its respective M or N axis (FIG. 1) to create the empty spaces 146 and 144 for allowing a lift to enter into the mattress . The cushioned pad 136 has also been removed to create the empty space 145. These empty spaces allow for insertion of devices that can help lift the patient, when a need arises. In another embodiment, removing the pad 136 would make the loop 10 of FIG. 1 be exposed and upon coupling a hook and lift upward will provide the Trendelenburg position.

Accordingly, the fully assembled orthopedic mattress can be used in a variety of ways to move the patient into multiple positions. This enables the patient to move various parts of their body without having to move others and helps prevent bedsores and other health risks associated with prolong bed rest. The mattress also enables caregivers to easily and comfortably change a patient's clothes, wash their body and provide a multitude of other care services. Furthermore, because the mattress is formed from various smaller sections, it can be easily assembled and dissembled to provide easy portability.

In one embodiment, the multi-positional orthopedic mattress can be placed on a regular bed and in another embodiment this mattress can be placed on the floor. When the mattress is on the floor, there are no boundaries as with a bed and the patient loses their fear of falling and can achieve their full movement potential.

The separation of various components in the examples described above should not be understood as requiring such separation in all examples, and it should be understood that the described components and systems can generally be integrated together in a single packaged into multiple systems.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus the following claims are hereby incorporated into the Detailed Description, with each claim standing on its own as a separately claimed subject matter.

What is claimed is:

1. A portable multi-positional orthopedic mattress comprising:

a top layer including a plurality of separately removable pads;

an intermediate layer including a plurality of sections; and a foldable bottom layer including a plurality of pads, wherein at least one of the plurality of pads is not movable while at least another one of the plurality of pads can be rotated around an axis, wherein:

the bottom layer is configured to be placed directly on a floor or on a conventional bed and includes a middle section, the plurality pads of the bottom layer include two higher-side pads and two lower-side pads on each side of the middle section, the two lower-side pads are configured to rotate outward around a first and second axis to provide access for a lift to get closer to a center of gravity of a patient when the mattress is placed on the floor, the intermediate layer when in a fully closed position is inserted within the bottom layer such that the intermediate layer rests on the middle section and is surrounded by the two-higher side pads and the two lower-side pads and does not extend beyond the pads of the bottom layer, the intermediate layer includes an outer frame. a first structure, a second structure, a third structure, a fourth structure, a fifth structure, a sixth structure, a seventh structure, and an eight structure removably coupled to each other by one or more pins, the outer frame is configured to fit into the bottom layer and includes a lower part and an upper part, the lower part includes two slots,. two locking mechanisms. a loop for attaching a lifting, mechanism, and two openings, the upper part includes a first set of protrusions, a first railing, and a first opening on a first side and a second set of protrusions, a second railing, and a second opening on a second side parallel to the first side and connected to the first side at one end of the first and second railings, the upper part and the lower part of the outer frame are coupled together by aligning the openings of the lower part and the upper part and insetting a pin through them.

the first structure includes a main structure including a plurality of protruded portions and sidings on a first side and a plurality of protruded portions and sidings on a second side parallel to the first side, the second structure includes a reverse bridge, a loop, two U-shaped sections, a plurality of openings, and a connector connecting the two U-shaped sections, the third structure includes two T-shaped portion each including two protrusions, an opening, and a barrier.

the T-shaped portions are fitted into the second structure by aligning each of the T-shaped portion into corresponding one of the U-shaped section by aligning the corresponding openings with the corresponding two protrusions of the T-shaped portion to enable the T-shaped portions to rotate in one direction only, the second and third structures are coupled to the first structure by aligning each opening of the third structure with a corresponding base hinge of the first structure and passing a pin through them, and the fourth structure includes two loops, two arms, and protrusions, the fifth structure includes two coaxial hinges, coaxial openings, and two hollow rods, the sixth structure includes a connector and coaxial openings, the seventh structure includes two connectors having openings on each side, the eight structure includes two rods each having one opening on one side, the fifth structure, the sixth structures and the seventh structure are connected together rotatably through openings of the fifth structure, openings of the sixth structure, and openings of the seventh structure by pins, a locking mechanism is connected to a top portion of the fifth structure and is configured to provide an ability to lock the fifth structure and the sixth structure so they are immovably attached to each other, the openings of the eight structure are aligned with protruded portions of the first structure before the openings of the eight structure are inserted into opening of hollow rods of the fifth structure, the protruded portions of the first structure are inserted into openings of the seventh structure, and the protrusions of the fourth structure are rotatably connected to the hinges of the fifth structure before being covered with an upper body support plate.

2. The multi-positional orthopedic mattress of claim 1, wherein the top layer comprises a top area pad, a middle area pad, and three lower area pads.

3. The multi-positional orthopedic mattress of claim 2, wherein an angle of the top area pad, middle area pad, and lower area pads can be adjusted with respect to each other.

4. The multi-positional orthopedic mattress of claim 1, wherein a hook can be inserted into the loop of the lower part and pulled upward to change the angle between the lower part and the upper part of the bottom layer.

5. The multi-positional orthopedic mattress of claim 1, wherein a hook of a lift can be inserted into the loop of the lower part to move the mattress to a desired position.

6. The multi-positional orthopedic mattress of claim 1, wherein the two higher-side pads are configured to be placed underneath an upper body part of a patient and the two lower-side pads are configured to be placed underneath a lower body part of the patient.

7. The multi-positional orthopedic mattress of claim 1, wherein the main structure includes a first loop on the first side.

8. The multi-positional orthopedic mattress of claim 7, wherein the main structure includes a second loop on the second side.

9. The multi-positional orthopedic mattress of claim 8, wherein a reverse Trendelenburg position can be formed using a hook and the first loop and second loop of the main structure.

10. The multi-positional orthopedic mattress of claim 1, wherein the reverse bridge connects the two U-shaped sections of the second structure.

* * * * *